US009388657B2

(12) United States Patent
Nelson

(10) Patent No.: US 9,388,657 B2
(45) Date of Patent: Jul. 12, 2016

(54) AUTOMATIC ANNULAR BLOW-OUT PREVENTER

(71) Applicant: Clinton D. Nelson, Wauconda, IL (US)

(72) Inventor: Clinton D. Nelson, Wauconda, IL (US)

( * ) Notice: Subject to any disclaimer, the term of this patent is extended or adjusted under 35 U.S.C. 154(b) by 352 days.

(21) Appl. No.: 13/941,034

(22) Filed: Jul. 12, 2013

(65) Prior Publication Data

US 2014/0014361 A1 Jan. 16, 2014

Related U.S. Application Data

(60) Provisional application No. 61/671,374, filed on Jul. 13, 2012.

(51) Int. Cl.
*E21B 33/06* (2006.01)

(52) U.S. Cl.
CPC ..... *E21B 33/06* (2013.01)

(58) Field of Classification Search
CPC ..... E21B 29/08; E21B 33/06; E21B 33/061; E21B 33/062; E21B 33/063; E21B 33/064
See application file for complete search history.

(56) References Cited

U.S. PATENT DOCUMENTS 2,812,197 A * 11/1957 Gibson ..... E21B 33/06 277/327
2,846,178 A * 8/1958 Minor ..... E21B 33/06 166/80.1
3,614,111 A 10/1971 Regan
4,007,904 A * 2/1977 Jones ..... E21B 33/06 251/1.2
4,095,805 A * 6/1978 Allen ..... E21B 33/06 251/1.1
4,099,699 A * 7/1978 Allen ..... E21B 33/06 251/1.2
4,458,876 A * 7/1984 Schaeper ..... E21B 33/06 251/1.2
4,460,151 A * 7/1984 Williams, III ..... E21B 33/06 251/1.2
6,367,804 B1 * 4/2002 Watts ..... E21B 33/062 251/1.2
7,389,817 B2 * 6/2008 Almdahl ..... E21B 33/064 166/361
7,779,918 B2 * 8/2010 Cowie ..... E21B 33/063 166/373
8,353,497 B2 * 1/2013 Trevas ..... E21B 33/06 166/387
8,555,980 B1 * 10/2013 Powell ..... E21B 43/0122 166/363
9,074,450 B2 * 7/2015 Weir ..... E21B 33/06
2002/0148616 A1 10/2002 Whitelaw et al.
2011/0297396 A1 12/2011 Hendel et al.
2014/0110610 A1 * 4/2014 Levett ..... E21B 33/06 251/1.1

OTHER PUBLICATIONS

International Preliminary Report on Patentability, PCT/US2014/046404 dated Jan. 21, 2016, including Written Opinion of the International Searching Authority.

* cited by examiner

*Primary Examiner* — Robert E Fuller
(74) *Attorney, Agent, or Firm* — Scherrer Patent & Trademark Law, P.C.; Stephen T. Scherrer; Monique A. Morneault

(57) ABSTRACT

A blow-out preventer contains high pressure material within a drill casing. Specifically, an automatic blow-out preventer cuts off communication between a casing and a riser automatically when pressures rise within the casing. More specifically, the blow-out preventer comprises a plurality of curved blades or "petals" that automatically close to seal off casing pressure from riser pressure when pressure rises within the casing.

20 Claims, 7 Drawing Sheets

AUTOMATIC ANNULAR BLOW-OUT PREVENTER

The present invention claims priority as a non-provisional application under 35 U.S.C. 119 to U.S. Provisional Patent Application No. 61/671,374, entitled "Automatic Annular Blow-Out Preventer," filed Jul. 13, 2012, which is incorporated herein by reference in its entirety.

TECHNICAL FIELD

The present invention relates to a blow-out preventer utilized to ensure that high pressure material stay contained and do not enter an oil platform riser, thereby preventing explosions, damage, oil spills, injury, loss of life and other issues that may be common to oil platform accidents. Specifically, the present invention relates to an automatic blow-out preventer that cuts off communication between a casing and a riser automatically when pressures rise within the casing. More specifically, the blow-out preventer comprises a plurality of curved blades or "petals" that automatically close to seal off casing pressure from riser pressure when pressure rises within the casing, such as any time a kick occurs, or an otherwise abnormal increase in flow or pressure within the casing.

BACKGROUND

It is, of course, generally known to utilize pipes for the transport of fluids under high pressure. Oil and gas drilling and mining requires a length of pipe to be sunk into a well disposed through the earth to reach pockets of petroleum oil and gas that may be disposed beneath the earth's surface. In some cases, pipes may reach extreme lengths to extract petroleum oil and gas from deep within the earth.

Typically, a well is sunk, whether vertically, angled, or even horizontally through the earth to reach the pockets of petroleum oil and/or gas. A drill bit is utilized to reach the necessary depths and create the well. A pipe casing is typically disposed within the well to reinforce the well, and control the flow of petroleum products from deep within the earth to the surface. Upon completion of the well and the reinforced pipe casing, the reinforced pipe casing may be utilized to transport the petroleum products to the surface.

Oil and gas drilling, however, may be very dangerous, considering that in many cases the oil and/or gas contained deep within the earth may be at extreme pressures. Caution is typically taken when drilling to prevent the explosive movement of petroleum products (or other fluids) to the surface, which may cause injuries or death to individuals and/or damage to expensive equipment. Moreover, when a well is completed, the transport of petroleum products may be under very high pressures. A blow-out may also occur if the pressure of the petroleum products deep within the earth causes an uncontrolled explosive release through the casing during production. Explosive release of petroleum products, or other fluids, through wells can occur unexpectedly, as pockets of oil and/or gas or other fluids become accessible deep within the earth.

To prevent the explosive release of fluids through a well, blow-out preventers are typically used. The most common type of blow-out preventer is a ram- or shear-type. Generally, a ram-type blow-out preventer utilizes a steel ram or shear blade or a plurality of steel rams or shear blades that, when engaged, uses hydraulic force to rapidly and forcefully squeeze the pipe together at a pinch point or otherwise shear the pipe to restrict or eliminate the flow of fluids through the pipe. Ram-type or shear-type blow-out preventers, while useful, are prone to failure. Indeed, there has been an evolution in the oil and gas industry over the last several decades to include stronger and more durable pipes for use in oil and gas drilling. The stronger and more durable a pipe may be, the more difficult it may be to pinch off the pipe during the closure process to prevent or otherwise stop a blow-out.

Moreover, annular blow-out preventers may be utilized to attempt to effectively cut-off high pressure within a casing. Annular blow-out preventers typically utilize hydraulic pistons to force closed an annular seal, typically made of steel-reinforced rubber. The hydraulic pistons, typically disposed beneath the annular seal, engage the annular seal, driving it to close upon the drill pipe within the casing.

Yet, even with ram or shear-type and annular blow-out preventers installed, catastrophic release of petroleum products is still a common occurrence, and still dominates news. For example, a high profile oil well blow-out in the recent past was the Deepwater Horizon oil well in the Gulf of Mexico. On Apr. 20, 2010, a blow-out occurred on an oil rig platform many miles off the coast of the United States in the Gulf of Mexico, spilling many millions of barrels of oil into the Gulf of Mexico, becoming one of the most serious environmental emergencies in American history. It is not entirely known what caused the blow-out and resulting oil spill, but it is theorized that a pocket of extremely high pressure methane gas traversed the pipe in the well and ignited upon exiting, causing the oil platform to explode, catch fire and sink two days after the blow-out.

Ram-type and annular blow-out preventers had been installed in the Deepwater Horizon platform to prevent or stop a blow-out through the pipe, but for reasons not entirely understood, the blow-out preventer failed. First, it appears that the blow-out preventers did not automatically operate to pinch or shear off the pipe and prevent the spill of oil and gas into the Gulf of Mexico. In addition, when triggered remotely, it appears that the ram failed to pinch or otherwise shear off the pipe adequately. One theory holds that the pipe, disposed through the ram-type blow-out preventer, was bent in the location of the ram at the time of the explosion. When the ram was remotely triggered and closed around the pipe, the ram failed to engage the pipe at the necessary location to close and pinch-off the pipe. Moreover, it appears that power was lost to the blow-out preventers preventing the same from operating properly during the catastrophic event. Thus, a need exists for a more durable and consistent safety system than heretofore utilized to prevent the catastrophic release of fluid from a well due to extreme sudden pressures and extreme velocity fluctuations of fluids, such as liquid and/or gas that may flow therethrough.

SUMMARY OF THE INVENTION

The present invention relates to a blow-out preventer utilized to ensure that high pressure material stay contained and do not enter an oil platform riser, thereby preventing explosions, damage, oil spills, injury, loss of life and other issues that may be common to oil platform accidents. Specifically, the present invention relates to an automatic blow-out preventer that cuts off communication between a casing and a riser automatically when material flow and/or pressures rise within the casing. More specifically, the blow-out preventer comprises a plurality of curved blades or "petals" that automatically close to seal off casing pressure from riser pressure when pressure rises within the casing.

It is, therefore, an advantage and objective of the present invention to provide a more durable and consistent safety system than heretofore utilized to prevent the catastrophic release of fluid from a well due to extreme sudden pressures and extreme velocity fluctuations of fluids, such as liquid and/or gas that may flow therethrough.

Moreover, it is an advantage and objective of the present invention to provide a blow-out preventer to prevent the explosive release of material from a well that operates automatically and without electricity or hydraulic power, but can activate as needed.

In addition, it is an advantage and objective of the present invention to provide a blow-out preventer that operates automatically without the need of engagement by an individual.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a blow-out preventer utilized to ensure that high pressure material stay contained and do not enter an oil platform riser, thereby preventing explosions, damage, oil spills, injury, loss of life and other issues that may be common to oil platform accidents. Specifically, the present invention relates to an automatic blow-out preventer that cuts off communication between a casing and a riser automatically when pressures rise within the casing. More specifically, the blow-out preventer comprises a plurality of curved blades or "petals" that automatically close to seal off casing pressure from riser pressure when pressure rises within the casing.

Preferably, the present invention comprises a self-activating blow-out preventer for use in a pipe having material flowing therethrough, such as used in oil drilling. The present invention generally comprises a plurality of petals, leafs or fins hinged in a circle, overlapping and forming a dome-like multi-layered structure of overlapping petals, leafs or fins, much like a cabbage. The dome preferably faces toward the pressure side, and may open to full port for maximum flow of material, such as drill mud in a drill pipe, casing and riser. The petals, leafs or fins may preferably be made of titanium, high-tempered stainless steel, or any other equivalent material, and may be capable of withstanding the high temperature and pressure down hole in an oil drill stack.

Figure 1:
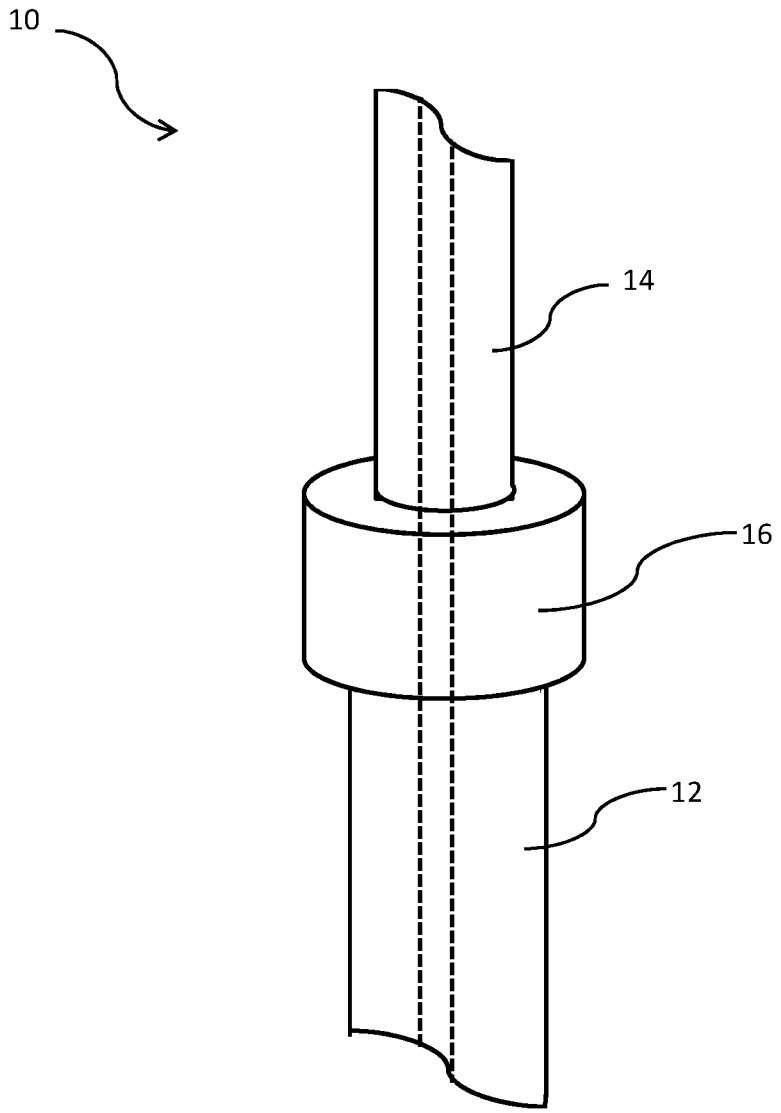
FIG. 1 illustrates a perspective view of a well, including a drill casing, a blow-out preventer and a riser in an embodiment of the present invention.

Now referring to the figures, wherein like numerals refer to like parts, FIG. 1 illustrates a well 10 comprising a casing pipe 12 and a riser 14. A blow-out preventer 16 according to the present invention is positioned between the casing pipe 12 and the riser 14. A drill pipe 18 is positioned within both the casing pipe 12 and the riser 14, and traverses through the blow-out preventer 16.

It should be noted that the blow-out preventer, as described hereinbelow, may be utilized in place of traditional annular or ram-type blow-out preventers. In addition, the blow-out preventer described herein may be utilized in addition to traditional blow-out preventers, thereby providing additional security in case of catastrophic pressure increases.

Figure 2:
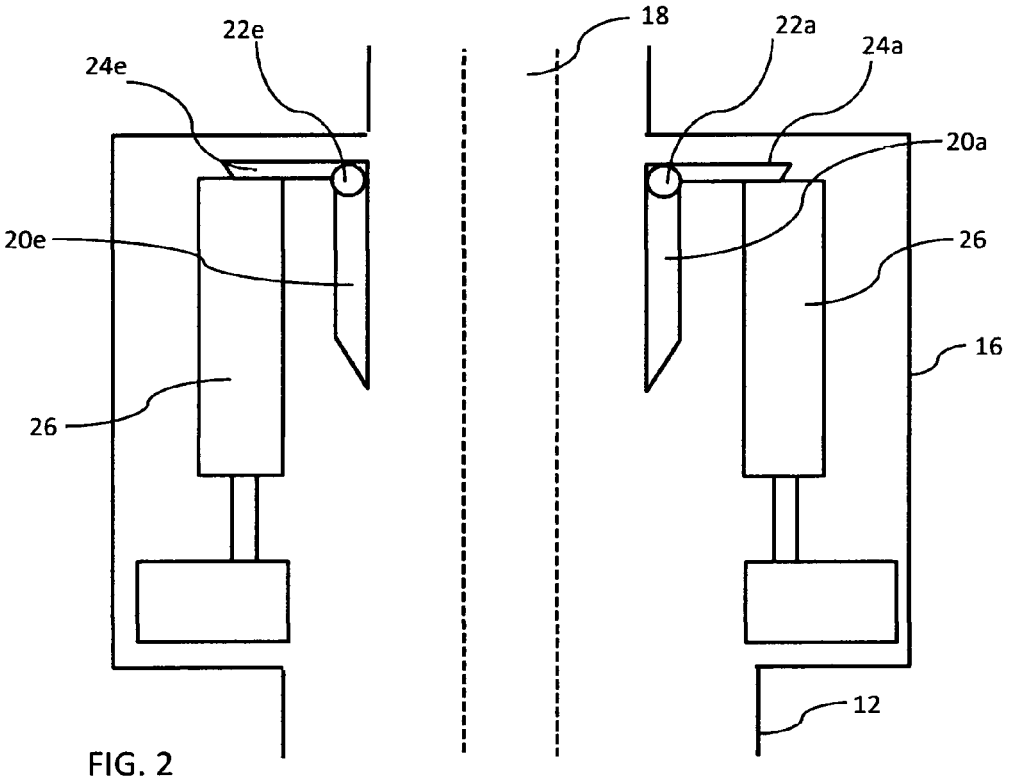
FIG. 2 illustrates an internal side view of a blow-out preventer in an embodiment of the present invention.
Figure 3:
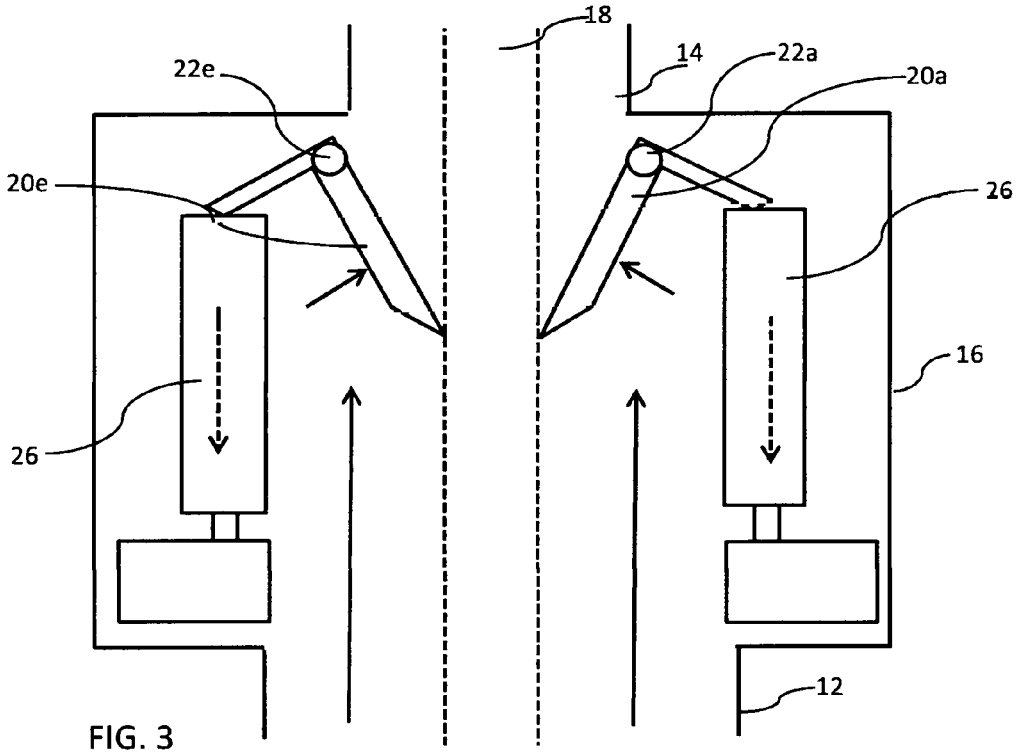
FIG. 3 illustrates an internal side view of a blow-out preventer activated due to internal pressures in an embodiment of the present invention.
Figure 7:
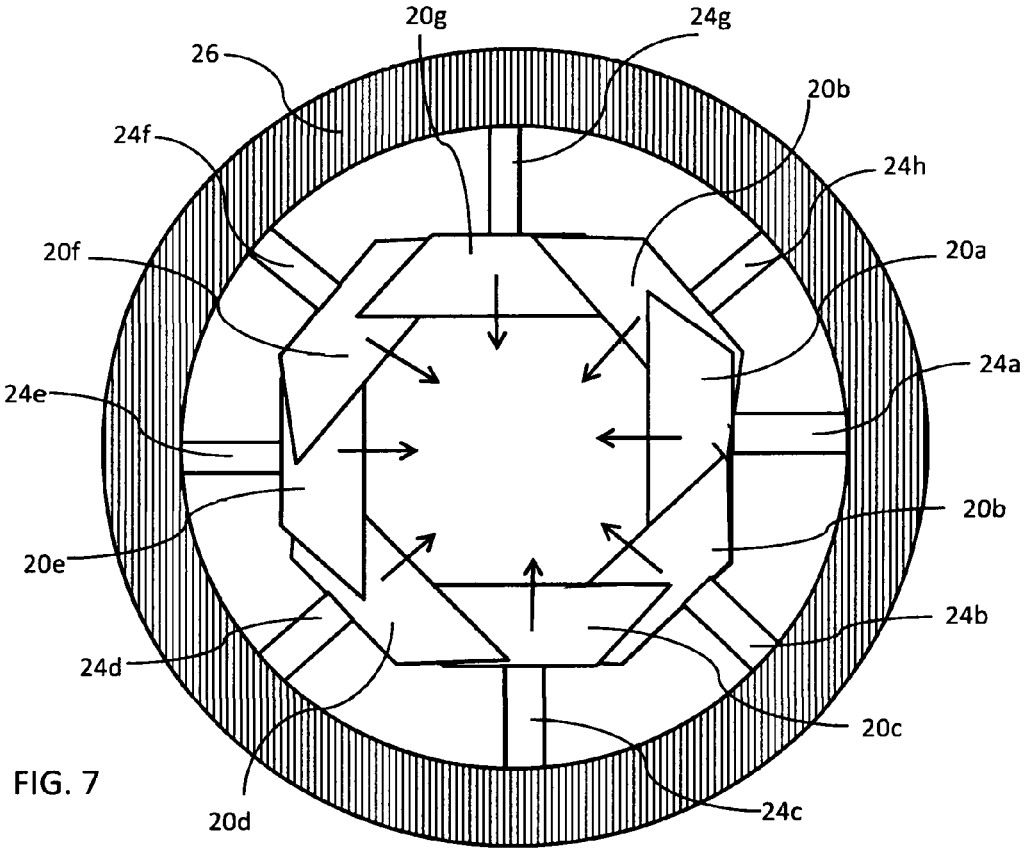
FIG. 7 illustrates a bottom view of the annular diaphragm mechanism in an embodiment of the present invention.

FIG. 2 illustrates an internal side view of the blow-out preventer 16, in an embodiment of the present invention. The blow-out preventer 16 connects to the casing pipe 12 on a bottom side thereof, and the riser 14 on a top side thereof. Within the blow-out preventer 16 may be positioned a plurality of blades 20*a*, 20*e*, although a plurality of additional blades (not shown) are disposed in like position as the blades 20*a*, 20*e*, around the blow-out preventer to form a system of overlapping blades, as illustrated in FIG. 7, which illustrates eight blades 20*a*-20*h* disposed around the inside of the blow-out preventer 16. The plurality of blades acts as a diaphragm to close upon the drill pipe 18, as illustrated in FIG. 3, or to simply completely close the passage between the casing pipe 12 and the riser 14, if no drill pipe is present.

The blades may have a curved shape, much like the overlapping blades of a cabbage, so that the blades may overlap annularly and provide an effective seal when closed. As illustrated in FIG. 2, the blades 20*a*, 20*e* may be disposed on pivots 22*a*, 22*e* which may allow the blades to close toward the center of the blow-out preventer. The closing of the blades inwardly may be caused by an increase in pressure within the casing pipe 12. Specifically, as pressure increases within the casing pipe 12, the resultant pressure within the blow-out preventer 16 may cause the blades to move inwardly toward the drill pipe 18, as illustrated in FIG. 3. Thus, when pressure increases, the blades may close around the drill pipe 18, effectively sealing the plurality of blades 20*a*, 20*e* (and other blades disposed therein) to the drill pipe 18, as illustrated in FIG. 3. Thus, the higher the pressure within the casing pipe 12, the more effectively the blades 20*a*, 20*e* and other blades, may seal against the drill pipe 18, effectively preventing the pressure from escaping into or otherwise entering the riser 14. When the blades move inwardly, flanges 24*a*, 24*e* may move downwardly, as the flanges 24*a*, 24*e* may be fixed to the blades 20*a*, 20*e*, and may pivot downwardly when the blades pivot inwardly along pivots 22*a*, 22*e*.

The blades may further close upon a drill pipe as the drill pipe descends during a drilling process, providing security for the ensuring that sudden increases in pressure do not rise into the riser and cause catastrophic problems. In addition, as the blades close upon the drill pipe 18 contained within the casing pipe 12, the blades may act to prevent movement of the drill pipe, either laterally or longitudinally.

Figure 4:
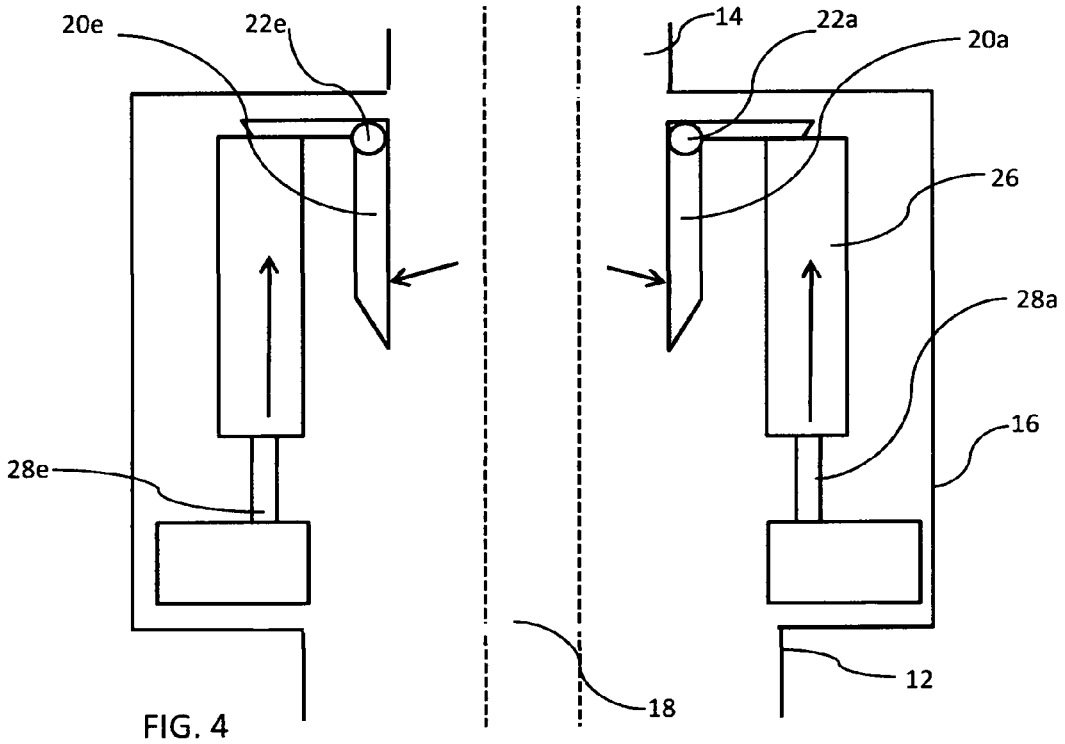
FIG. 4 illustrates an internal side view of a blow-out preventer reset after activation in an embodiment of the present invention.

An annular-shaped rubber element 26 may be disposed annularly within the blow-out preventer 16, and may have the ability to move upwardly and downwardly, as necessary. The flanges 24*a*, 24*e* may be connected or otherwise rest upon the annular rubber element 26, which may cause the rubber element 26 to be pushed downwardly when the blades move inwardly, as illustrated in FIG. 3. The annular element 26 may be connected to a plurality of hydraulic pistons 28*a*, 28*e*, as shown in FIGS. 2-6, which may be utilized to push the annular element upwardly after pressures have decreased within the casing pipe 12, as illustrated in FIG. 4. This may allow the blow-out preventer to effectively reset itself after a high pressure incident therein, opening up the blades 20*a*, 20*e* (and others) to allow fluid to flow therethrough.

Figure 5:
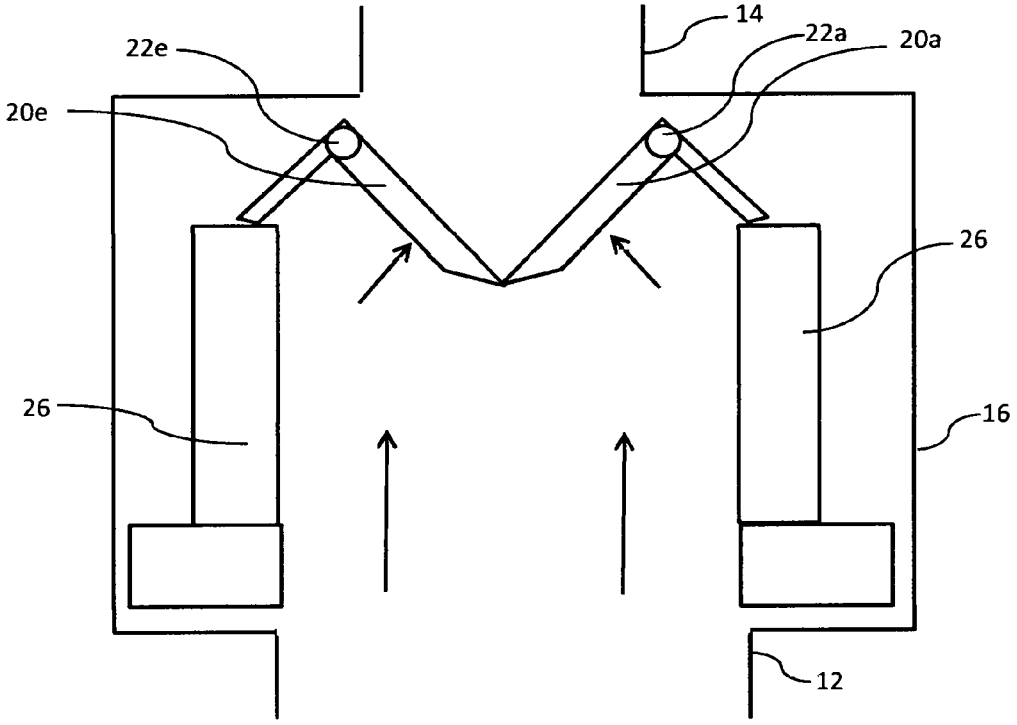
FIG. 5 illustrates an internal side view of a blow-out preventer closed within a drill casing without a drill pipe in an embodiment of the present invention.

FIG. 5 illustrates a high pressure event within a casing pipe 16 where no drill pipe is present for the blades to seal upon. When high pressure enters the blow-out preventer 16, the blades may move inwardly, by the force of the pressure, until the blades meet at the center thereof, effectively sealing the pressure from entering the riser 14.

Figure 6:
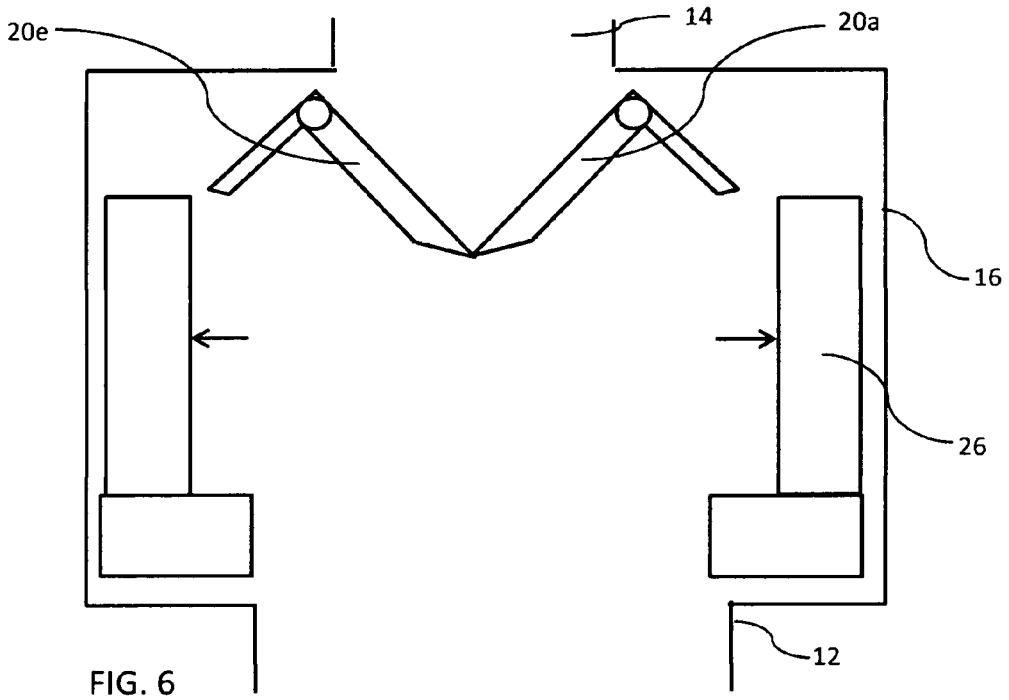
FIG. 6 illustrates an internal side view of a blow-out preventer in a closed configuration in an embodiment of the present invention.

FIG. 6 illustrates an extreme high pressure event, where the pressure within the casing pipe 12 causes not only the blades to move inwardly and seal (either upon a drill pipe, or together if no drill pipe is present), but also move the annular element 26 outwardly, as illustrated by the arrows in FIG. 6, thereby disconnecting the rubber element from the flanges 22*a*, 22*e* (and others associated with other blades). Thus, movement of the annular element effectively locks the blades 20*a*, 20*e* (and others) in place, as the blades will not be able to be reset when the annular element has expanded due to extremely high pressures.

FIG. 7 illustrates a bottom view of the plurality of blades 20*a*-20*h* and respective flanges 24*a*-24*h*. Further, the annular rubber element 26 is partially shown. When pressure increases within the casing pipe (not shown in FIG. 7), the blades may pivot inwardly, as shown by the plurality of arrows, closing the passage connecting the casing pipe to the riser, effectively sealing the flow of materials into the riser, preventing a blow-out. Although eight blades are shown in FIG. 7, it should be noted that any number of blades may be utilized to effectively close when pressure increases. In addition, the blades may be curved at their ends, such as if the blades are designed to seal around a round drill pipe, as illustrated in FIG. 3, to more effectively seal the same. Moreover, the blades may be made of any material apparent to withstand the pressures they may face. For example, the blades may be made of steel or other metal, and may further have other materials, such as on their ends, that may allow the blades to seal more effectively, such as rubber, for example. Specifically, the blades may be made of titanium or hardened steel that may be encased or blanketed by a rubber membrane that may be utilized to provide a more effective seal when closed.

It should be noted that the blow-out preventer as described herein may be utilized without power. Indeed, the blow-out preventer is triggered to close off pressures at the moment of the pressure increase, negating the need for power or an individual to recognize that a problem exists. In an embodiment of the present invention, power may be utilized for opening the blow-out preventer after a catastrophic increase in pressure. Thus, the present invention may be utilized to completely seal the casing around a drill pipe even without power or if a catastrophic event triggers a power loss.

Figure 8:
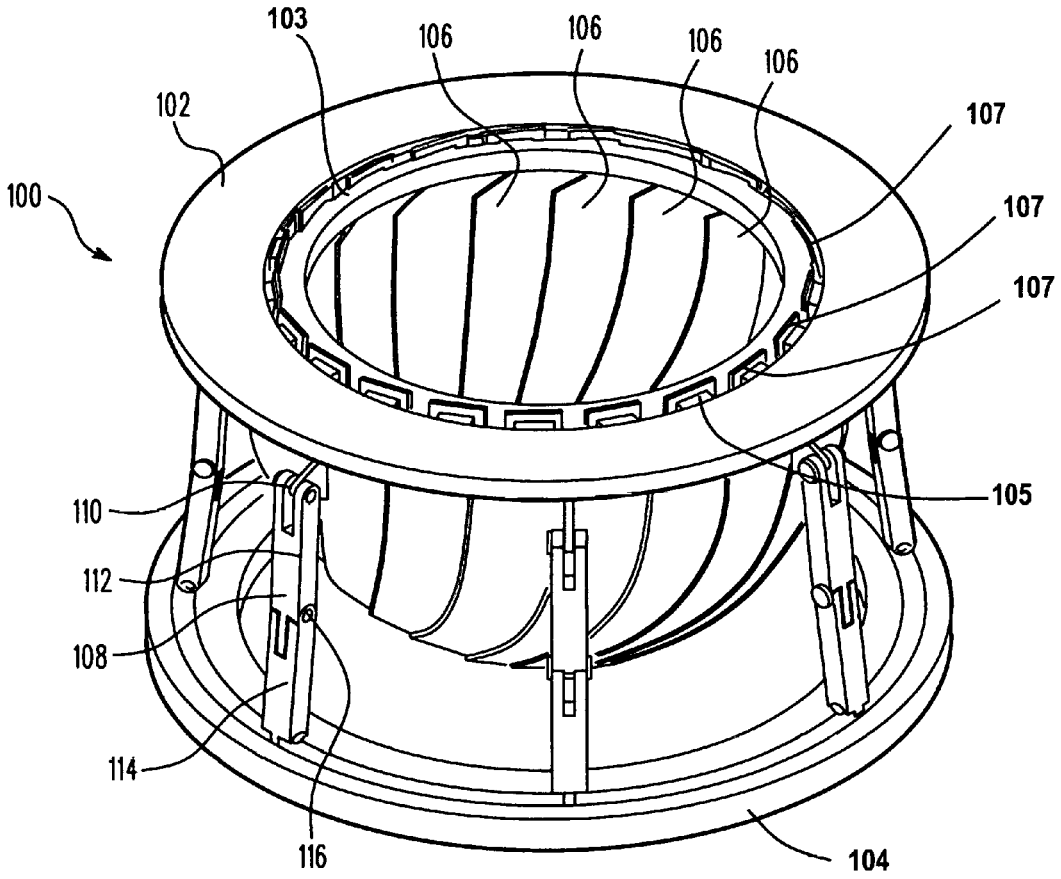
FIG. 8 illustrates a perspective view of a housing containing a plurality of closable fins in an embodiment of the present invention.

FIG. 8 illustrates a preferred embodiment of the present invention of an internal housing 100 that may be utilized in the blow-out preventer of the present invention. Specifically, the housing 100 may comprise an upper ring 102 and a lower ring 104 within which a plurality of petals, leafs or fins 106 may be disposed concentrically around a central axis. One or more of the petals, leafs or fins 106 may be attached to a leg 108 via a flange 110 that may extend from the one or more petals, leafs or fins. Each of the legs 108 may be bifurcated into an upper leg portion 112 and a lower leg portion 114, with a hinge that may be disposed between the upper and lower leg portions 112, 114 connecting the same together. Thus, the legs 108 may be collapsible. In an alternate embodiment, each of the legs 108 may be a hydraulic cylinder that may move upwardly or downwardly, or inwardly or outwardly, as disclosed above with reference to FIGS. 2-6.

When collapsed, each of the legs 108 may pull a corresponding petal, leaf or fin 106 downwardly, thereby moving each of the petals or fins centrally toward the center axis, effectively closing the space formed at the central axis between the edges of the petals or fins 108. Indeed, in a preferred embodiment of the present invention, the petals, leafs or fins 106 may be arranged to close completely, effectively sealing the space beneath the petals, leafs or fins 106 from the space above the petals or fins 106. Specifically, a plurality of petals, leafs or fins 106 may be connected to collapsible legs 108, and the overlapping configuration of the petals, leafs or fins 106 may close all of the petals, leafs or fins 106 together.

Moreover, if a drill pipe (not shown) is present, the petals, leafs or fins 106 may be arranged and the edges of each shaped to engage with the drill pipe to effectively seal the petals, leafs or fins 106 around the drill pipe to prevent movement of material from below the petals, leafs or fins 106 to above the petals, leafs or fins 106.

Figure 9:
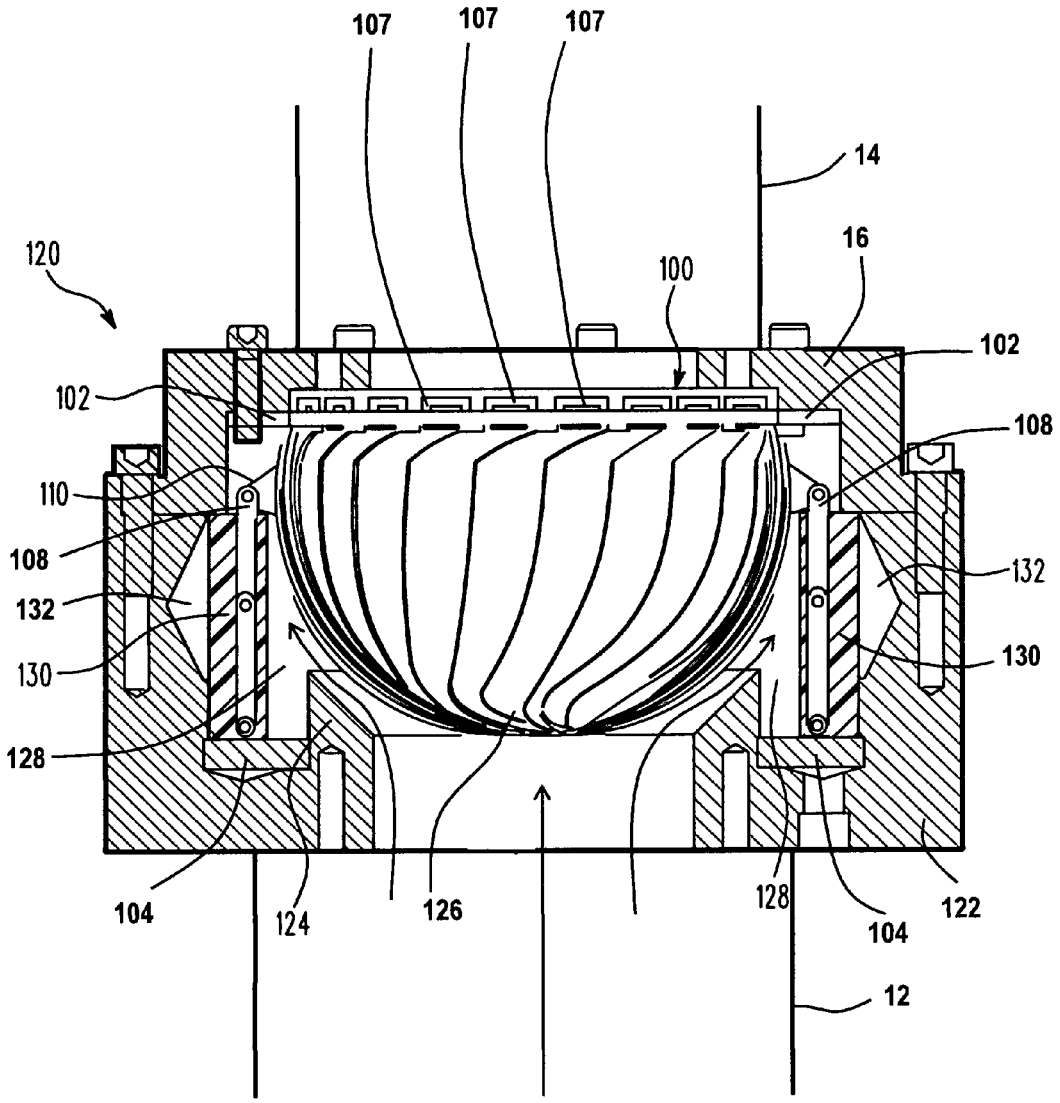
FIG. 9 illustrates a cut-away view of a blow-out preventer with closeable fins in an embodiment of the present invention.
Figure 10:
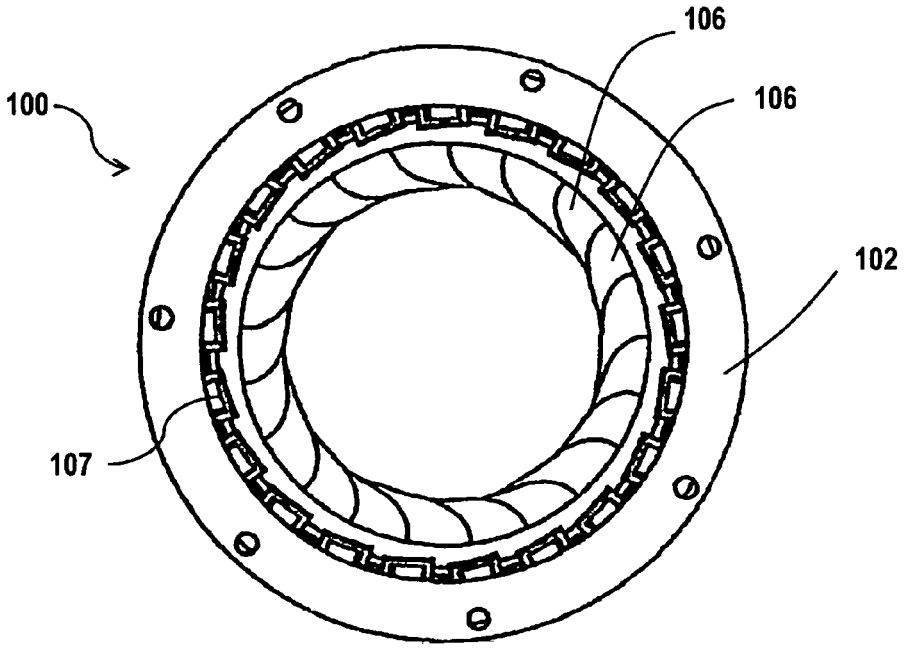
FIG. 10 illustrates a top view of a blow-out preventer apparatus in an open configuration in an embodiment of the present invention.
Figure 11:
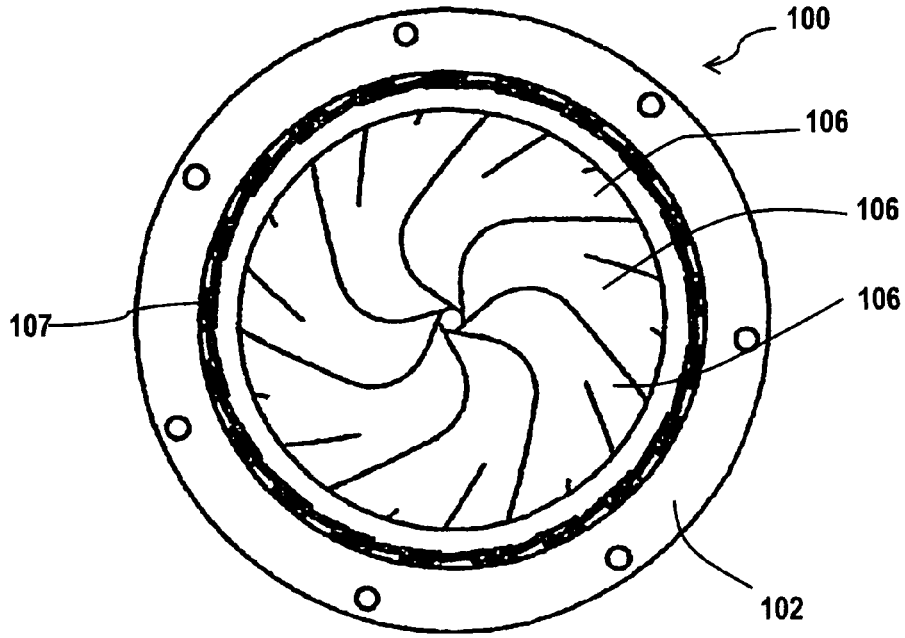
FIG. 11 illustrates a top view of a blow-out preventer apparatus in a closed configuration in an embodiment of the present invention.

FIG. 9 illustrates a cut-away version of a blow-out preventer 120 in a preferred embodiment of the present invention, comprising the housing 100, as described above with reference to FIG. 8, situated within a casing 122. The blow-out preventer 120 is represented shown as blow-out preventer 16 in FIG. 1, and FIG. 9 further illustrates casing pipe 12 and riser 14. The blow-out preventer 120 may comprise a space for holding the housing 100, including the petals, leafs or fins 106, but may provide an area for material to flow therethrough. Specifically, material that may be desired for removal, such as oil, gas, or the like, under normal pressure or operating pressure may flow through a space 126 formed between the bottom edges of the petals, leafs or fins 106. Material may also flow between the seat 124 and the petals, leafs or fins 106 to fill the internal cavity 128. As with the embodiments described above with respect to FIGS. 2-7, the petals, leafs or fins 106 may rotate on hinges 107, several of which are shown on FIGS. 8 and 9, and close upon a drill pipe that may be disposed within the space 126 between the bottom edges of the petals, leafs or fins 106. Specifically, the hinges 107 allow rotation of the petals, leafs or fins 106 due to the petals, leafs or fins 106 having apertures on a top end of the petals, leafs or fins 106 through which flanges 105 extend between the upper ring 102 and an inner ring 103. Each of the petals, leafs or fins 106 freely move inwardly and outwardly due to rotating upon flanges 105. Alternatively, if there is no drill pipe present, then the petals, leafs or fins 106 may close inwardly to contact one another at bottom edges thereof and close the space 126, cutting off the flow of material from therebeneath. FIG. 10 illustrates a top view of blow-out preventer 120 with the petals 106 in an open configuration, and FIG. 11 illustrates a top view of blow-out preventer 120 with the petals 106 in a closed configuration.

The collapsible legs may be encased within a sheath 130 that may be made of a flexible yet sturdy material, such as a reinforced rubber or other like material. When pressure builds within the blow-out preventer 120, such as during a catastrophic pressure increase caused by a pressure spike or the like, material forced into the cavity 128 due to the increased pressure may cause the legs 108 to collapse within the sheath 130, causing the flange 110 to move downwardly, thereby closing the petals or fins 106 by rotating on the hinges 107. Indeed, the legs 108 and the sheath 130 may collapse to fill a space 132 around the sheath having a shape to generally hold the sheath and legs therein. It should be noted that the blow-out preventer 120 may operate without legs, as a sudden increase in pressure will push against the petals, leafs or fins 106 from therebeneath, automatically closing them. A decrease in pressure allows the petals, leafs or fins 106 to open the space 126. The legs may be pushed by an outside force to move the petals, leafs or fins 106 to re-open the space 126, as represented by the upward arrows in FIG. 9.

To open the petals, leafs or fins 106 after the pressure spike has been released, such as with a bleed that may be within the blow-out preventer (not shown), pistons may be utilized to push the legs 108 and the sheath 130 into a non-collapsed configuration, thereby opening the petals, leafs or fins 106, allowing material to flow therethrough.

Although the present invention specifically describes a blow-out preventer for use with oil drilling systems, it should be noted that the present invention may be incorporated into any system having a flow of material through a pipe, where it is desired to prevent a kick or sudden increase in pressure and/or flow of materials therethrough. The present invention effectively blocks and seals the pressure and/or flow of material during periods of abnormally high pressure and/or material flow.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A blow-out preventer apparatus comprising:

a housing configured to fit within a pipe, the housing comprising an upper ring and a lower ring, and a plurality of hinged, overlapping, curved and downwardly extending petals, each of the plurality of the petals connected to the upper ring via a hinge, the petals forming an iris diaphragm having an upper chamber above the petals and a lower area below the petals, each of the plurality of petals having an outside surface facing the lower area below the petals and an inside surface facing the upper chamber above the petals, and further wherein bottom edges of the overlapping petals form an opening around a central axis, the opening configured to allow material within the pipe to flow therethrough at a pressure, wherein the overlapping petals open and close around the central axis, wherein the iris diaphragm formed by the plurality of petals is configured to close around the central axis when a sudden increase in the pressure of material is exerted upon the outside surface of the petals, effectively sealing the upper chamber from the lower region.

2. The blow-out preventer apparatus of claim 1 further comprising:

an internal pipe disposed along the central axis, running from the lower area below the petals through the central opening formed by the overlapping petals wherein the sudden increase in the pressure of material exerted upon the outside surface of the petals causes the petals to close around the internal pipe.

3. The blow-out preventer apparatus of claim 1 further comprising:

a leg disposed adjacent the outside surface of one of the petals, an end of the leg connected to the one of the petals at a top thereof near the hinge connecting the petal to the upper ring and configured to pull the petal downwardly, wherein movement of the end of the leg downwardly causes the petal to close the central opening.

4. The blow-out preventer apparatus of claim 3 wherein the leg is hinged at an intermediate location thereof so as to be collapsible.

5. The blow-out preventer apparatus of claim 3 further comprising a sheath disposed around the leg.

6. The blow-out preventer apparatus of claim 5 wherein the sheath is bendable, allowing the leg to move.

7. The blow-out preventer apparatus of claim 6 further comprising:

a space between the sheath and the plurality of petals, wherein the sudden increase in pressure from the material exerted against the outside surfaces of the plurality of petals causes the end of the leg to move downwardly, closing the opening.

8. The blow-out preventer apparatus of claim 1 wherein the lower ring comprises a surface, wherein a space is formed between the bottom edges of the petals and the surface of the lower ring allowing the material to flow through a space between the seat and the bottom edges of the petals.

9. The blow-out preventer of claim 1 further comprising:

a plurality of legs, each of the legs having an end attached to one of the plurality of petals at a top thereof near the hinge connecting the one of the petals to the upper ring, wherein movement of the ends of the plurality of legs downwardly causes the plurality of petals to close the central opening.

10. The blow-out preventer apparatus of claim 1 further comprising:

a casing within which the housing sits, the casing connected to a drill casing therebeneath and a riser thereabove.

11. A method for closing a blow-out preventer upon a sudden increase in pressure within a pipe, the method comprising:

providing a pipe, and a blow-out preventer apparatus disposed within the pipe, the blow out preventer apparatus comprising a housing configured to fit the blow-out preventer apparatus within the pipe, the housing comprising an upper ring and a lower ring, and a plurality of hinged, overlapping, curved and downwardly extending petals, each of the plurality of the petals connected to the upper ring via a hinge, the petals forming an iris diaphragm having an upper chamber above the petals and a lower area below the petals, each of the plurality of petals having an outside surface facing the lower area below the petals and an inside surface facing the upper chamber above the petals, and further wherein bottom edges of the overlapping petals form an opening around a central axis, the opening configured to allow material within the pipe to flow therethrough at a pressure, wherein the overlapping petals open and close around the central axis, wherein the iris diaphragm formed by the plurality of petals is configured to close around the central axis when a sudden increase in the pressure of material is exerted upon the outside surface of the petals, effectively sealing the upper chamber from the lower area; and closing the petals around the central axis upon the sudden increase in pressure within the housing caused by the material flowing therethrough, effectively sealing the upper chamber from the lower area.

12. The method of claim 11 further comprising the steps of:

providing an internal pipe disposed along the central axis, running from the lower area below the petals through the central opening formed by the overlapping petals; and closing the petals around the internal pipe upon the sudden increase in pressure of material through the housing.

13. The method of claim 11 further comprising the steps of:

providing a leg disposed adjacent the outside surface of one of the petals, an end of the leg connected to the one of the petals at a top thereof near the hinge connecting the petal to the upper ring; and moving the end of the leg downwardly causing the one of the petals to close toward the central axis, wherein the one of the petals causes the plurality of petals, being overlapping, to close the central opening.

14. The method of claim 13 wherein the leg is hinged at an intermediate location thereof so as to be collapsible; the method further comprising the step of:

collapsing the leg to move the top of the leg downwardly, causing the one of the petals to cause the plurality of petals to close the central opening.

15. The method of claim 13 wherein the leg is encased within a sheath.

16. The method of claim 15 wherein the sheath is bendable, allowing the leg to move.

17. The method of claim 16 further comprising the steps of:

providing a space between the sheath and the plurality of petals; and pressurizing the space, thereby causing an end of the leg to move and closing the central opening.

18. The method of claim 11 wherein the lower ring comprises a surface, wherein a space is formed between the bottom edges of the petals and the surface of the lower ring; and flowing material through the space between the surface of the lower ring and the bottom edges of the petals.

19. The method of claim 11 further comprising the steps of:

providing a plurality of legs, each of the legs having an end attached to one of the plurality petals at a top thereof near the hinge connecting the one of the petals to the upper ring; and moving the ends of the plurality of legs downwardly thereby causing the plurality of petals to close the central opening.

20. The method of claim 11 further comprising the steps of:

closing the petals thereby closing the central opening when a predetermined amount of pressure from the material flowing therethrough enters the blow-out preventer apparatus.

* * * * *